US009758967B2

(12) United States Patent
Persson

(10) Patent No.: US 9,758,967 B2
(45) Date of Patent: Sep. 12, 2017

(54) REINFORCEMENT ELEMENT FOR CASTING COMPRISING RING SHAPED PORTIONS AND REINFORCEMENT WITH SUCH REINFORCEMENT ELEMENTS

(75) Inventor: Johan Persson, Töre (SE)

(73) Assignee: SVENSK CELLARMERING FABRIK AB, Töre (SE)

( * ) Notice: Subject to any disclaimer, the term of this patent is extended or adjusted under 35 U.S.C. 154(b) by 289 days.

(21) Appl. No.: 13/878,587

(22) PCT Filed: Oct. 12, 2011

(86) PCT No.: PCT/SE2011/051220

§ 371 (c)(1),
(2), (4) Date: Apr. 10, 2013

(87) PCT Pub. No.: WO2012/050515

PCT Pub. Date: Apr. 19, 2012

(65) Prior Publication Data

US 2013/0196107 A1 Aug. 1, 2013

(30) Foreign Application Priority Data

Oct. 12, 2010 (SE) ..... 1001005

(51) Int. Cl.

| | |
|---|---|
| ***E04C 5/01*** | (2006.01) |
| ***E04C 5/06*** | (2006.01) |
| ***E04C 5/02*** | (2006.01) |
| *E04C 5/04* | (2006.01) |
| *E04C 5/07* | (2006.01) |

(52) U.S. Cl.

CPC ..... *E04C 5/01* (2013.01); *E04C 5/02* (2013.01); *E04C 5/06* (2013.01); *E04C 5/04* (2013.01); *E04C 5/07* (2013.01); *Y10T 428/18* (2015.01)

(58) Field of Classification Search

CPC ..... E04C 5/01; E04C 5/06
USPC ..... 52/649.1
See application file for complete search history.

(56) References Cited

U.S. PATENT DOCUMENTS

| | | | | |
|---|---|---|---|---|
| 1,390,073 | A * | 9/1921 | Allen | 52/649.1 |
| 1,610,996 | A | 12/1926 | Bruckshaw | |
| 3,232,422 | A | 2/1966 | Whyte | |
| 3,383,827 | A | 5/1968 | Schaich | |
| 3,454,455 | A | 7/1969 | Rasmussen | |
| 3,616,589 | A | 11/1971 | Sherard | |
| 3,711,145 | A | 1/1973 | Rapata | |
| 3,913,295 | A | 10/1975 | Thompson | |

(Continued)

FOREIGN PATENT DOCUMENTS

| | | |
|---|---|---|
| DE | 3 405 624 A1 | 8/1984 |
| EP | 0 674 060 A1 | 9/1995 |

(Continued)

OTHER PUBLICATIONS

Supplementary Search Report in related patent case EP11832842 dated Nov. 24, 2014.

(Continued)

*Primary Examiner* — William P Watkins, III
(74) *Attorney, Agent, or Firm* — Cooper Legal Group LLC

(57) ABSTRACT

Reinforcement element for being positioned within a cast to elastically withstand tensile loads thereon, said reinforcement element comprising a plane sheet- or plate-shaped body of at least one row of consecutively coupled ring-shaped portions.

20 Claims, 16 Drawing Sheets

(56) References Cited

U.S. PATENT DOCUMENTS

| | | | | |
|---|---|---|---|---|
| 4,024,688 | A * | 5/1977 | Calini | 52/378 |
| 5,888,608 | A | 3/1999 | Tsai | |

FOREIGN PATENT DOCUMENTS

| | | | |
|---|---|---|---|
| EP | 1 964 995 | A2 | 9/2008 |
| GB | 2078192 | A | 1/1982 |
| JP | 57140461 | A | 8/1982 |
| JP | 6048520 | A | 4/1985 |
| JP | 62287086 | | 12/1987 |
| JP | 1153563 | A | 6/1989 |
| JP | 11050528 | A | 2/1999 |
| JP | 2001220858 | | 8/2001 |
| SE | 330075 | B | 11/1970 |
| SU | 542808 | A1 | 1/1977 |
| WO | WO-01/55046 | A2 | 8/2001 |

OTHER PUBLICATIONS

International Search Report for PCT/SE2011/051220, mailed Jan. 31, 2012; ISA/SE.

Corresponding Colombian Application 13-110527-6, Colombian Office action dated Dec. 24, 2015, 6 pages.

Corresponding Japanese Application, Japanese Office action dated Jul. 28, 2015, 6 pages.

* cited by examiner

REINFORCEMENT ELEMENT FOR CASTING COMPRISING RING SHAPED PORTIONS AND REINFORCEMENT WITH SUCH REINFORCEMENT ELEMENTS

CROSS-REFERENCE TO RELATED APPLICATIONS

This application is a 371 U.S. National Stage of International Application No. PCT/SE2011/051220, filed on Oct. 12, 2011, which claims priority to Swedish Patent Application No. 1001005-6, filed Oct. 12, 2010, the contents of which are hereby incorporated by reference in their entirety as if fully set forth herein.

The present invention relates to a reinforcement element and a reinforcement comprising such reinforcement elements according the independent claims.

BACKGROUND OF THE INVENTION

Conventional reinforcements for casting comprise reinforcement rods which are attached to each other in structures. Such reinforcements have the disadvantage of providing a relatively poor load resistance to weight ratio. Furthermore, handling of the reinforcement rods and assembling them into reinforcement structures is a time consuming and heavy task.

Reinforcements with ring-shaped reinforcement elements are known and have the advantage that the ring-shaped structure provides a high load resistance. Ring-shaped structures are also advantageous because of their uni-directional load resistance properties. Ring-shaped reinforcement elements can not be locked to each other in an easy and natural way, as for example crossed straight reinforcement rods.

It is known to use small ring-shaped reinforcement elements which are mixed into the material in which they are to be casted. One example of such reinforcement elements is disclosed in U.S. Pat. No. 3,616,589A, which describes a reinforcement with ring-shaped reinforcement elements which are randomly distributed in the material in which they are casted into. WO0155046A2 also describe reinforcement elements of this type. The reinforcement elements comprise a longitudinally extending body having ring-shaped elements coupled to each end thereof. Such reinforcement elements have the disadvantage that the longitudinally extending body has a much lower load resistance than the ring-shaped elements, thereby providing a highly non-uniform load resistance of the reinforcement elements. In general, it is difficult to distribute the reinforcement elements evenly and they are not interconnected. Another disadvantage of this type of reinforcement elements is that the reinforcement in it self due to their small size adds little structural strength to the object into which they are casted (unlike for example a conventional reinforcement rod). Therefore, they are not suitable for applications where a high tensile strength is required.

Another type of reinforcement is also known, where individual ring-shaped reinforcement elements are linked together in various patterns. JP1153563A discloses a reinforcement with ring-shaped reinforcement elements which have been linked together in chains. The linking together requires individual handling of each ring-shaped reinforcement element, which is time and cost demanding. U.S. Pat. No. 1,610,996A discloses a reinforcement with ring-shaped reinforcement elements which have been linked together to with a byrnie, which also requires individual handling of each ring-shaped reinforcement element. Such linked together reinforcements may also provide a non-uniform strength and a low overall strength of the reinforcement it self.

SUMMARY OF THE INVENTION

An object of the invention is thereby to provide a reinforcement element and reinforcement comprising such reinforcement elements which do no require individual handling of each ring-shaped reinforcement element while still enabling a predetermined distribution. Another object of the present invention is to provide a reinforcement element with a high load resistance, and in particular a high load resistance to weight ratio.

These and other objects are achieved by a reinforcement element and a reinforcement comprising such reinforcement elements according to the independent claims.

The reinforcement elements and reinforcements according to the invention may be used for reinforcing for example concrete, EPS concrete (expanded polystyrene concrete), AAC (autoclaved aerated concrete), composite materials or the like.

The invention is based on the insight that the advantageous load resistance properties of a ring-shaped element may be used as a reinforcement element by forming the reinforcement element as a plane sheet- or plate-shaped body of at least one row of consecutively coupled ring-shaped portions. During casting the casting material fills the hole or space enclosed by the ring-shaped portion thereby achieved fixing the reinforcement element in the cast.

Surprisingly, the plane sheet- or plate-shaped body adds elasticity to reinforcement element. When positioned in the cast, e.g. a concrete floor or wall, and when subjected to tensile load, the ring-shaped portions transforms the tensile stress along the ring-shaped portions into pressure stress against the casting material enclosed by the ring-shaped portions. Due to the strong resistance to compression, but weak resistance to tension of most casting materials such as for example concrete, the reinforcement element according to the invention achieves advantageous reinforcing properties. The elasticity due to the plane and sheet- or plate-shaped body has the advantage that a reinforcement element material with a higher quality may be selected which in turn results in a stronger structure able to withstand higher strains or tensions. In a conventional reinforcement bar, relatively low strength steel may be necessary to allow sufficient elasticity, i.e. to avoid making the reinforcement bar brittle. Contrary to the prejudice that high strength steel is unsuitable for reinforcements, it has proven advantageous to use such high strength steel in a reinforcement element according to the invention. Thus is due to the elastic properties of the reinforcement element, which allows sufficient elasticity even with high strength steel. By using high strength steel, a high strength in relation to weight of the reinforcement element may be achieved.

In an embodiment, the consecutively coupled ring-shaped portions are coupled to each other via neck or coupling portions.

In another embodiment, the consecutively coupled ring-shaped portions are coupled to each other via neck or coupling portions along a centre line collinear with the centre of the ring-shaped portions in the row.

In yet another embodiment, the neck or coupling portions are plane sheet- or plate-shaped.

In yet another embodiment, the neck or coupling portions are configured with a cross-sectional dimension as viewed in the direction of the row able to withstand greater tensile load than that of the ring-shaped portion. This embodiment is advantageous because when the reinforcement element is subject to tensioning or bending forces, the ring-shaped portions may be elastically deformed. Thus, the reinforcement element may be tensioned in a predictable manner.

In yet another embodiment, at least one of the neck or coupling portions transcends into the ring-shaped portions to which it is coupled with a smoothly curved shape.

The reinforcement element according to the invention may be formed by die-cutting, punching, stamping, laser cutting, water cutting or cutting out the desired shape of the reinforcement element from a sheet of suitable material. It may be advantageous to form the holes of the ring portions by die-cutting, punching or stamping. Thereby, the material around the inner diameter of the ring-shaped portions may be hardened by deformation, such that the material around the inner diameter is harder than the rest of the reinforcement element. The reinforcement element as a whole may thereby achieve a higher strength but nearly unchanged tolerance for load and is thus not prone to rupture during load.

In an embodiment of a reinforcement arrangement for being positioned within a cast to elastically withstand tensile loads thereon, the reinforcement arrangement comprises at least a first and second reinforcement element, wherein said first reinforcement element is formed from a first material and said second reinforcement element is formed from a second material. Thereby, an electrical current may be generated there between when the reinforcement elements are casted into a casting material such as for example concrete in such a manner that the reinforcement elements are arranged at a distance from each other. The electrical current is achieved due to the ion transport between the two reinforcement elements via the casting material resulting from the two reinforcement elements being manufactured from different materials. The materials suitable to generate electrical current in this embodiment may be chosen from, but are not limited to, a group of aluminium, steel and stainless steel. The reinforcement arrangement may advantageously comprise several sets of first and second reinforcement elements which may be coupled in series electrically such that a higher voltage may be achieved.

The invention relates to a reinforcement element 1, 1*a-c*, 1*a*1-8, 1*b*1-7 for casting, comprising ring-shaped portions 2. The reinforcement element 1, 1*a-c*, 1*a*1-8, 1*b*1-7 comprises at least one row of consecutive ring-shaped portions 2 coupled to each other with necks 3. This provides the advantage that the ring-shaped portions 2 are placed correctly relative each other without further measures, and furthermore the reinforcement element can be manufactured from a substantially plane element.

In an advantegous embodiment, the neck 3 transcends to the ring-shaped portions 2 to which it is coupled with an evenly rounded shape which has the advantage that sharp transitions between the portions are avoided, which could have been indications of fracture.

In another advantegous embodiment, the reinforcement element 1, 1*a-c*, 1*a*1-8, 1*b*1-7 is formed such that at least one ring-shaped portion 2 comprises at least one cross brace 5*a, b* which extends over the opening of the at least one ring-shaped portion 2.

In another particularity advantegous embodiment, the reinforcement element comprises consecutively column wise arranged rows of consecutive ring-shaped portions 2, where at least one row of consecutive ring-shaped portions 2 are coupled to each other with necks 3. Such a reinforcement element may advantageously be folded and form a three dimensional reinforcement structure.

The inventions furthermore relates to a reinforcement comprising at least two sets of reinforcement elements. The lengthwise axis of the reinforcement elements in the first set is directed in a first lengthwise direction and the perpendicular to the plane of the reinforcement element directed in a first perpendicular direction, while the lengthwise axis of the reinforcement elements in the second set is directed in a second lengthwise direction and the perpendicular to the plane of the reinforcement element directed in a second perpendicular direction. At least one of the angle between the first and second lengthwise directions differ from zero or the angle between the first and second perpendicular directions differ from zero, and in one embodiment, all angles are right, which makes the reinforcement able to carry loads and torques from different directions well.

In an advantegous embodiment of the reinforcement, at least one of the necks of the first set of reinforcement elements rest on at least one of the necks of the other set of reinforcement elements. The first set of reinforcement elements will naturally fall in this position, which simplifies coupling together of a reinforcement from reinforcement elements.

In another advantegous embodiment, the reinforcement is divided into at least two subsets of reinforcement elements, where at least one reinforcement element from the first subset overlaps at least one reinforcement element from the second subset such that a straight reinforcement member 6 can be thread through the ring-shaped portions 2 of both reinforcement elements. In such a manner, rows of reinforcement elements can be locked together end to end.

SHORT DESCRIPTION OF THE FIGURES

These and other aspects of the present invention will now be described in more detail, with reference to the appended drawings showing currently preferred embodiments of the invention, wherein:

FIG. 1 shows a first embodiment of a reinforcement element according to the invention, FIG. 2 shows a second embodiment of a reinforcement element according to the invention, FIG. 3 shows a third embodiment of a reinforcement element according to the invention, FIG. 4 shows a fourth embodiment of a reinforcement element according to the invention, FIG. 5 shows the load distribution on the fourth embodiment of the reinforcement element, FIG. 6 shows a first embodiment of a reinforcement with reinforcement elements according to the invention, FIG. 7 shows a second embodiment of a reinforcement with reinforcement elements according to the invention, FIG. 8 shows a third embodiment of a reinforcement with reinforcement elements according to the invention, FIG. 9 shows a fourth embodiment of a reinforcement with reinforcement elements according to the invention, FIG. 10 shows a first method of linking reinforcement elements together, FIG. 11 shows a second method of linking reinforcement elements together, FIG. 12 shows a third method of linking reinforcement elements together, FIG. 13 shows a fifth embodiment of a reinforcement element according to the invention, FIG. 14 shows the fifth embodiment of a reinforcement element being folded for reinforcement, FIG. 15 shows a method of casting reinforcement elements between end sheets, FIG. 16 shows a fifth embodiment of a reinforcement with reinforcement elements according to the invention, FIG. 17 shows a reinforcement with reinforcement elements according to the invention having means for coupling reinforcement elements together, FIG. 18 shows a another embodiment of a reinforcement with reinforcement elements according to the invention having means for coupling reinforcement elements together, FIG. 19 shows yet another embodiment of a reinforcement with reinforcement elements according to the invention having means for coupling reinforcement elements together, FIG. 20*a* shows an embodiment of a reinforcement with reinforcement elements according to the invention having means for coupling reinforcement elements together and/or for coupling for example a tube to the reinforcement, FIG. 20*b* shows the same reinforcement as FIG. 20*a*, where a tube is coupled to the reinforcement, FIG. 21 shows two embodiments of reinforcements with reinforcement elements according to the invention being coupled together, FIG. 22 shows two other embodiments of reinforcements with reinforcement elements according to the invention being coupled together, FIG. 23 shows an embodiment of a reinforcement element having channel elements for providing a flow duct function, FIG. 24 shows a plurality of the second embodiment of reinforcement elements according to the invention being arranged in an intersecting pattern, FIG. 25 shows a plurality of the second embodiment of reinforcement elements according to the invention being woven into an intersecting pattern, FIG. 26 shows measurement results from a declension test of a concrete beam being reinforced with a plurality of reinforcement elements according to the invention, and FIG. 27 shows measurement results from a declension test of an EPS concrete beam being reinforced with a plurality of reinforcement elements according to the invention.

DETAILED DESCRIPTION OF PREFERRED EMBODIMENTS

FIG. 1 shows a first embodiment of a reinforcement element 1 according to the invention. The reinforcement element comprises a row of ring-shaped portions 2 being coupled together with necks 3. The reinforcement element is typically cut from a plane plate- or sheet-shaped element extending in a plane, and this is the plane to which is referred when the text refers to the plane of the reinforcement element. The row comprising five ring-shaped portions are distributed along a straight line with an equal distance between two consecutive ring-shaped portions. The straight line along which the ring-shaped portions are arranged, and which extends through all centers of the portions, is denoted the lengthwise axis of the reinforcement element in the text below. The points on the outer diameter of each ring-shaped portion which is furthest away from the lengthwise axis on one side of the lengthwise axis is denoted top point, and on the other side bottom point.

The necks 3 which couple together each consecutive pair of ring-shaped portions have straightly cut sides which run in parallel with the lengthwise direction of the reinforcement element, and the necks have a width of approximately half of the outer diameter of the ring-shaped portions. The necks are symmetrically shaped relative the lengthwise axis. The widths of the necks as well as of the ring-shaped portions can be chosen in different ways, and the illustrated width is chosen just for clearly illustrating the principal structure. The illustrated embodiments of necks of course only constitute examples, and the concept neck can refer to any type of connecting element which couples together consecutive ring-shaped portions.

With a reinforcement element according to this embodiment, the strength and load resistance of a ring-shaped reinforcement element is achieved, and thereto the ring-shaped reinforcement portions are distributed in a controlled manner without requiring coupling together of the ring-shaped reinforcement portions in a further assembly step.

FIG. 2 shows a second embodiment of a reinforcement element according to the invention which is distinguished from the first by having a rounded transition between the ring-shaped portions 2 and the necks 3. With the abrupt transition in the first embodiment, an indication of fracture is achieved resulting in that the ring-shaped portions are more easily ruptured from each other at this transition. In the second embodiment, the inner and outer contours of the reinforcement element lack such edges.

In other words, the transition between the ring-shaped portions forms a convex shape or a convexly shaped portion of the outer periphery of the reinforcement element. The radius or curvature of the transition may be chosen to be smaller or greater than what is illustrated in FIG. 2, the illustrated curved shape is just for illustrative purposes. In other embodiments, the transition between the ring-shaped portions may have a different shape, although it is advantageous if the shape is such that no edges or corners are formed in the transition between the ring-shaped portions. The transitions between the ring-shaped portions may be shaped such that the outer peripheries of the long sides of two reinforcement elements being displaced relative each other half the distance between the holes of two adjacent ring portions is an exact fit to each other. This is advantageous because a single punch, die cut or cut of a steel sheet may be used to form the long sides of two reinforcement elements, thereby saving manufacturing time and reducing waste.

Although FIG. 2 and FIG. 3 shows embodiments having five consecutively coupled ring-shaped portions, this is just for illustrative purposes. The number of ring-shaped portions of a reinforcement element according to the invention is determined by the desired length of the reinforcement element. Thus, other embodiments of the invention may have any number of ring-shaped portions.

FIG. 3 shows a third embodiment of a reinforcement element according to the invention, which in terms of the shape of the reinforcement element is identical with the reinforcement element according to the second embodiment. It is distinguished although by that the material around the inner diameter of the ring-shaped portions is differently hardened 4 than the rest of the reinforcement element. Typically, the hardening around the inner diameter of the ring-shaped portions is such that the material is harder here, but since the rest in return is less rigid, the reinforcement element as a whole achieves a higher strength but nearly unchanged tolerance for load and is thus not prone to rupture during load.

FIG. 4 shows a fourth embodiment of a reinforcement element according to the invention which to great extents is formed as the reinforcement element according to the second embodiment, but thereto comprises a cross shaped portion 5*a, b* in the center of each ring-shaped portion. The cross shaped portion 5*a, b* consists of two crossing braces, a first brace 5*a* running diagonally over the opening hole, and a second brace 5*b* running diagonally over the opening hole with an angle between the two braces of at least 60°. The braces are typically also cut from the same plane plate- or sheet-shaped element as the rest of reinforcement element, and are for providing additional strength to the element.

FIG. 5 shows the load distribution on the fourth embodiment of the reinforcement element during an external load directed from above and straight downwards, which loads the top point of the middle ring-shaped portion. The reinforcement element 1*a* rests on two lower reinforcement elements 1*c,b*, which are illustrated from their short end side. The lower reinforcement elements 1*c, b* rest on the reinforcement element 1*a* with cross shaped portions on the bottom side of the both neck portions which surround the middle ring-shaped portion.

With the reinforcement elements resting in the illustrated way, the external load result in internal loads on the reinforcement element which to a great extent is applied on the braces in the direction of the lengthwise direction of the braces. Because the braces have a significant resistance to compression in their lengthwise direction, a large part of the load will be moved from ring parts of the ring-shaped portions. Later on in the text, it is described how the reinforcement elements can be arranged such that it rests in just the way illustrated in this figure, and then cross braces are particularity advantageous.

FIG. 6 shows a first embodiment of a reinforcement with reinforcement elements according to the invention. The reinforcement is built from two sets of reinforcement elements 1*a*1-3, 1*b*1-3 which together form a three dimensional structure. Both sets of reinforcement elements are formed from individual reinforcement elements according to the first embodiment.

The first set of reinforcement elements 1*b*1-3 contains three reinforcement elements which all lie in the same plane, side by side with parallel axes in the lengthwise direction.

On top of the first set of reinforcement elements, the second set of reinforcement elements 1*a*1-3 is arranged, whose axes in the lengthwise direction run in parallel with the axis in the lengthwise direction of the first set of reinforcement elements. The perpendicular of the second set of reinforcement elements 1*a*1-3 extend in a right angle from the perpendicular of the first set of reinforcement elements. The bottom points of the ring-shaped portions of the second set of reinforcement elements are arranged in the openings between the reinforcement elements of the first set of reinforcement elements 1*a*1-3. The two sets of reinforcement elements are thus displaced relative each other in the lengthwise directions with a distance corresponding to half the distance between two consecutive ring-shaped portions.

With the two sets of reinforcement elements arranged in this manner, a high density of reinforcement elements is achieved because the second set of reinforcement elements partly extend below the first set of reinforcement elements. The manner in which they are arranged is also natural, because the second set tends to fall down as far as possible, which places them in just the position as the first embodiment of the reinforcement describes. This way of reinforcing also locks the reinforcement elements in position relative each other.

In the figure, it appears as if the reinforcement elements rest on each other and the standing reinforcement elements balance on their edges. Obviously, the reinforcement elements can be attached to each other by welding, frapping or in another way. The illustrations only show two layers in the reinforcement, but the reinforcement can of course be extended to comprise further layers corresponding to first and second sets alternately arranged in a corresponding way.

In another embodiment of the reinforcement, the sets of reinforcement elements 1*a*1-3, 1*b*1-3 may comprise reinforcement elements according to the second embodiment. The same properties and at least the same advantages as described above with reference to the embodiment shown in FIG. 6 also applies to the embodiment with reinforcement elements according to the second embodiment.

FIG. 7 shows a second embodiment of reinforcement with reinforcement elements according to the invention comprising two sets of reinforcement elements 1*a*1-3, 1*b*1-3. In the figure, both sets of reinforcement elements are illustrated standing on their ends, where the second set 1*a*1-3 rests on the first set 1*b*1-3.

In the second embodiment of the reinforcement, the necks of the reinforcement elements 1*a*-1-3 of the second set rest on the necks of the reinforcement elements 1*b*1-3 of the first set. This implies that the distance between two neighbouring reinforcement elements 1*b*1-3 of the first set corresponds to the distance between two consecutive ring-shaped elements and also that the distance between two neighbouring reinforcement elements 1*a*1-3 of the second set corresponds to the distance between two consecutive ring-shaped elements. This embodiment also implies that the second set of reinforcement elements 1*a*1-3 naturally falls down as far as possible on the first set of reinforcement elements 1*b*1-3 and lies there relatively stable.

In another embodiment of the reinforcement, the sets of reinforcement elements 1*a*1-3, 1*b*1-3 may comprise reinforcement elements according to the second embodiment. The same properties and at least the same advantages as described above with reference to the embodiment shown in FIG. 7 also applies to the embodiment with reinforcement elements according to the second embodiment.

FIG. 8 shows a third embodiment of reinforcement with reinforcement elements according to the invention, which embodiment comprises two sets of reinforcement elements 1*a*1-2, 1*b*1-7. In the figure, the first set 1*b*1-7 is illustrated as standing reinforcement elements arranged side by side with parallel axes in the lengthwise direction. In the first set of reinforcement elements, every other element is displaced a distance corresponding to half the distance between two neighbouring ring-shaped elements in the lengthwise direction. In the first set 1*b*1-7 of reinforcement elements, the distance between two reinforcement elements running in parallel next to each other corresponds to half the distance between two neighbouring ring-shaped elements.

The second set of reinforcement elements 1*a*1-2 lies on top of the first set 1*b*1-7 of reinforcement elements, and the axes in the lengthwise direction of the second set of reinforcement elements 1*a*1-2 is arranged in a right angle against the axes in the lengthwise direction of the first set 1*b*1-7 of reinforcement elements, in parallel with the perpendicular of the first set 1*b*1-7 of reinforcement elements.

With the first set 1*b*1-7 of reinforcement elements arranged in this manner, each ring-shaped element receives the top point of a ring-shaped element of the second set 1*a*1-2, while the necks of the reinforcement elements of the second set 1*a*1-2 rest against the necks of the first set 1*b*1-7 of reinforcement elements. This embodiment also implies that the second set of reinforcement elements 1*a*1-2 falls naturally down into the position as described for the third embodiment. It is distinguished from the first and second in that the number of reinforcement elements in the first set 1*b*1-7 is twice as densely placed, which provides increased strength.

In another embodiment of the reinforcement, the sets of reinforcement elements 1*a*1-2, 1*b*1-7 may comprise reinforcement elements according to the second embodiment. The same properties and at least the same advantages as described above with reference to the embodiment shown in FIG. 8 also applies to the embodiment with reinforcement elements according to the second embodiment.

FIG. 9 shows a fourth embodiment of reinforcement with reinforcement elements according to the invention comprising two sets of reinforcement elements 1*a*1-8, 1*b*1-7. The two sets are arranged with one set 1*b*1-7 on top of the other set 1*a*1-8. The reinforcement elements in the upper set 1*b*1-7 rest with their necks on the top points of the ring-shaped elements in the lower set of reinforcement elements 1*a*1-8, and the reinforcement elements in the upper set 1*b*1-7 rest with their bottom points on the necks of the lower set of reinforcement elements 1*a*1-8.

All reinforcement elements in the lower set are arranged side by side with the axes in the longitudinal direction in parallel with each other, and with each plane of the reinforcement elements displaced a distance in the direction of the perpendicular of the reinforcement elements. All reinforcement elements in the upper set are arranged in the same manner, but with the planes of the reinforcement elements directed in a right angle from the plane of the reinforcement elements of the lower set.

In each set of reinforcement elements, every other reinforcement element is displaced in its lengthwise direction corresponding to half the distance between two consecutive ring-shaped elements. This increases the density of the reinforcement compared to the second embodiment of reinforcement, and thereto provides twice as many support points for the reinforcement elements towards the upper and lower sets of reinforcement elements respectively.

In another embodiment of the reinforcement, the sets of reinforcement elements 1*a*1-8, 1*b*1-7 may comprise reinforcement elements according to the second embodiment. The same properties and at least the same advantages as described above with reference to the embodiment shown in FIG. 9 also applies to the embodiment with reinforcement elements according to the second embodiment.

FIG. 10 shows a reinforcement which to great extent corresponds to the second embodiment of reinforcement, but thereto illustrates a first method of linking reinforcement elements belonging to the same set of reinforcement elements together. Two upper sets of reinforcement elements 1*a*1-3 are arranged on top of the lower, standing set of reinforcement elements, wherein each reinforcement element of the first upper set of reinforcement elements 1*a*1-3 run in parallel with and partially overlaps a reinforcement element in the second upper set of reinforcement elements 1*b*1-3.

Because the upper sets of reinforcement elements are forced to be equally distributed, the right most ring-shaped element in each reinforcement element of the first upper set will overlap with the left most ring-shaped element of each reinforcement element of the second upper set. In such a manner, a channel is formed which extends through all these ring-shaped elements, and through these a straight reinforcement bar 6 may be thread. Thus, this straight reinforcement bar 6 locks each reinforcement element of the first upper set together with a reinforcement element of the second upper set.

This way of locking together can be continued such that long series of sets of reinforcement elements are locked together, and in a corresponding manner the lower set of reinforcement elements can of course also be locked together in long rows until the desired length and width of the locked together reinforcement is achieved. In addition, the layers of reinforcement elements can be extended in height an unlimited number of times such that the desired height is achieved.

In another embodiment of the reinforcement, the sets of reinforcement elements may comprise reinforcement elements according to the second embodiment. The same properties and at least the same advantages as described above with reference to the embodiment shown in FIG. 10 also applies to the embodiment with reinforcement elements according to the second embodiment.

FIG. 11 shows a second method of linking reinforcement elements together with a linking element 7. The linking element 7 is shaped as a reinforcement element, but with a smaller diameter of the ring-shaped portions, and is intended to extend along and on the side of two in the lengthwise direction following reinforcement elements, wherein one half of the linking element 7 is arranged along and on the side of the first reinforcement element and the other half of the reinforcement element 7 is arranged along and on the side of the second reinforcement element. The linking element is attached to both reinforcement elements in the usual way and thereby couples them together.

FIG. 12 shows a third method of linking reinforcement elements together which is similar to the first method of linking reinforcement elements together. The method is illustrated with two sets of reinforcement, wherein each reinforcement to a great extent corresponds to the second embodiment of reinforcement, but distinguishes it self in that every other reinforcement element is displaced in its lengthwise direction relative the neighbouring reinforcement element a distance corresponding to the distance between two neighbouring ring-shaped elements.

Thereby, every other reinforcement element extend out from the reinforcement, and by shifting two such reinforcements side by side in a suitable manner, the extending ring-shaped elements of a one of the reinforcement is received in the space between the extending ring-shaped elements of the second reinforcement. These extending ring-shaped elements, every other belonging to a first reinforcement and the other to a second reinforcement forms a long row of ring-shaped elements through whose openings a linking element may be thread in such a manner as is illustrated in connection with FIG. 10. The difference is that the reinforcement elements never lies in pairs immediately adjacently with each other, thereby utilizing the reinforcement more efficiently.

FIG. 13 shows a fifth embodiment of a reinforcement element according to the invention, which can be described as five rows of reinforcement elements according to the second embodiment arranged side by side. Unlike in the second embodiment, where the reinforcement elements are separate, necks extend in a transverse direction between the reinforcement elements in the fifth embodiment such that the entire fifth embodiment of the reinforcement element forms a single, coupled together, plane element. This single element could for example have replaced the whole first set of separate reinforcement elements 1*b*1-3 in the first embodiment of reinforcement according to the invention. The necks extending in the transverse direction between the reinforcement elements may be thinner than in the FIG. 13. It may be advantageous when reinforcing concrete, especially for casting floors, that the individual reinforcement elements are more loosely coupled to each other such that the rows of reinforcement elements may break apart from each other. In other words, the necks in the transverse direction may be formed or shaped such that adjacent reinforcement elements or rows of ring-shaped portions are coupled together to allow discoupling therebetween when being subject to tensile or bending forces.

FIG. 14 shows the fifth embodiment of a reinforcement element folded to a three dimensional reinforcement. The reinforcement element according to the fifth embodiment has been folded ninety degrees in one direction along two consecutive rows with necks and thereafter been folded ninety degrees in the other direction along two thereafter consecutive rows with necks. This folding sequence is thereafter repeated along the full length of the reinforcement such that the resulting reinforcement occupies a three dimensional space in contrast to the plane individual reinforcement elements in the previous embodiments of reinforcement elements. This reinforcement may advantageously be used for reinforcing walls, particularity for reinforcing autoclaved aerated concrete. In other words, the reinforcement forms a part of the wall structure. In such an application, the reinforcement may be standing up on the short edges of the reinforcement elements. Plaster boards or the like may be attached to the reinforcement element directly. Alternatively, casting moulds may be used to cast the reinforcement element into the wall. The casting moulds may be temporarily attached directly to the reinforcement, in particular they may be attached by means of a self-adhesive to the reinforcement. In some applications and casting materials, it may be advantageous that the individual reinforcement elements are coupled such that adjacent reinforcement elements or rows of ring-shaped portions are coupled together to allow discoupling therebetween when being subject to tensile or bending forces.

FIG. 15 shows a method of casting reinforcement elements between end plates 8*a, b*. Individual reinforcement elements are arranged to form a reinforcement according to the second embodiment with two layers of reinforcement elements arranged on top of each other. The reinforcement is arranged between a lower end plats 8*a* and an upper end plate 8*b*, typically plaster boards. By casting concrete between the end plates, a reinforced plate shaped element with plaster surfaces is achieved which can be used as a building element for walls with plaster boards.

FIG. 16 shows a fifth embodiment of a reinforcement with reinforcement elements according to the invention suitable for reinforcing for example pillars or columns. The reinforcement comprises a plurality of reinforcement elements according to the second embodiment of the invention. The reinforcement consists of four elongated side portions. The four side portions are attached to each other on their long ends to form a closed column, i.e. they are angled ninety degrees relative to each other. Each side portion is formed from five reinforcement elements being coupled together on their long ends. The next outermost reinforcement elements of each side portion are folded inwards approximately 45 degrees relative to the outermost reinforcement elements. Thereby, the middle reinforcement element is recessed inwards.

FIG. 17 shows a reinforcement with three reinforcement elements 1*a*, 1*b*, 1*c* according to the invention being arranged in parallel, folded ninety degrees relative to each other, and coupled to each other on their long ends. The end holes of the outermost two reinforcement elements are not fully cut or punched out. In this embodiment, a length corresponding to approximately one tenth of the circumference of the holes is left un-cut or un-punched. Thereby, spacer or interconnecting portions 9*a*, 9*b* of the reinforcement elements may be folded outwards. Put differently, the spacer or interconnecting portions may be described as a plane sheet- or plate-shaped folding portion coupled to an inner periphery portion of the ring-shaped portion. These spacer or interconnecting portions 9*a*, 9*b* may be used as spacers for convenient installation of a plurality of reinforcement elements. In other words, reinforcement elements having spacers formed from folded spacer or interconnecting portions 9*a*, 9*b* of the reinforcement elements may be conveniently arranged in for example a casting mould with a predetermined distance (corresponding to the length of the spacer or interconnecting portions) between each other, thereby forming a uniform distribution of reinforcement elements. The spacer or interconnecting portions 9*a*, 9*b* may also advantageously be used for coupling together reinforcement elements or reinforcements. By inserting spacer or interconnecting portion(s) of one reinforcement element or reinforcement into holes of another reinforcement element or reinforcement, placing the reinforcement elements or reinforcement in abutment with each other, and thereafter displacing the reinforcement elements or reinforcements away from each other along their lengthwise direction, the reinforcement elements or reinforcements are fixed to each other. In such a manner, a plurality of reinforcement elements or reinforcements may be combined to form a desired structure. In other embodiments, the reinforcement may comprise a different number of reinforcement elements, and/or may comprise a different number of spacer or interconnecting portions. In yet other embodiments, the spacer or interconnecting portion(s) may be folded to a different angle or different angles.

FIG. 18 shows a another embodiment of a reinforcement with reinforcement elements 1*a, b, c* according to the invention being similar to the embodiment shown in FIG. 17. Two spacer or interconnecting portions 10*a*, 10*b* are formed by only partially cutting or punching out two holes of one end of the outermost two reinforcement elements. The spacer or interconnecting portions 10*a*, 10*b* are beveled or phased to form straight portions at either side of the portion of the circle which is in contact with the corresponding reinforcement element. The straight portions are parallel with the short side direction of the corresponding reinforcement element and arranged at a distance therefrom being equal to or greater than the thickness of the reinforcement elements. By inserting spacer or interconnecting portion(s) of one reinforcement element or reinforcement into holes of another reinforcement element or reinforcement, placing the reinforcement elements or reinforcement in abutment with each other, and thereafter displacing the reinforcement elements or reinforcements away from each other along their lengthwise direction, the reinforcement elements or reinforcements are fixed to each other. Since the spacer or interconnecting portion(s) 10*a*, 10*b* are beveled, reinforcement elements or reinforcements may be more strongly coupled to each other. The spacer or interconnecting portions 10*a*, 10*b* may furthermore be used as spacers in the same way as with the embodiment of FIG. 17 described above. The spacer or interconnecting portion(s) may in another embodiment be folded downwards to be essentially parallel with the corresponding reinforcement element(s) in order to further increase the contact area and strength of coupling between the reinforcement elements or reinforcements coupled together by means of the spacer or coupling portion(s). The spacer or interconnecting portion(s) may in yet another embodiment have a smaller diameter than the holes of the reinforcement elements.

FIG. 19 shows yet another embodiment of a reinforcement with reinforcement elements 1*a, b, c* according to the invention being similar to the embodiment shown in FIG. 18. Two beveled spacer or interconnecting portions 11*a*, 11*b* are formed in the same way as in FIG. 18. The spacer or interconnecting portions 11*a*, 11*b* are toothed along their sides in order to further improve the coupling strength between reinforcement elements or reinforcements coupled together by means of the spacer or interconnecting portion(s). In another embodiment, the spacer or interconnecting portions 11*a*, 11*b* may have the same shape as in FIG. 17, i.e. not bevelled or phased. The spacer or interconnecting portions 11*a*, 11*b* may furthermore be used as spacers in the same way as with the embodiment of FIG. 17 described above.

FIG. 20*a* shows an embodiment of a reinforcement with reinforcement elements according to the invention being similar to the embodiment shown in FIG. 18. The outermost reinforcement elements 1*a* and 1*b* have two spacer or interconnecting portions 12*a, b, c, d* each arranged at a distance from each other in the lengthwise direction of the reinforcement elements. The spacer or interconnecting portions 12*a*, 12*b*, 12*c*, 12*d* are formed in the same way as in FIG. 18, but are formed with a circular through hole. The tips of the spacer or interconnecting portions 12*a*, 12*b*, i.e. the portion of the spacer or interconnecting portions being furthest away from the reinforcement elements, are cut to form an opening to corresponding through holes. In other words, the spacer or interconnecting portions are cut to form two separate curved hooks. The spacer or interconnecting portions may be used to couple together reinforcement elements or reinforcements in the same way as described for the embodiment in FIG. 18. The spacer or interconnecting portions 12*a, b, c, d* may furthermore be used as spacers in the same way as with the embodiment of FIG. 17 described above. The spacer or interconnecting portions 12*a, b, c, d* may also be used to attach a pipe, tube, electrical cable or the like to the reinforcement. FIG. 20*b* shows the same reinforcement as FIG. 20*a*, where a tube is attached to the reinforcement by placing it inside the cut open through hole or between the hooks.

FIG. 21 shows two reinforcements according to the invention being coupled together. The reinforcements each comprise reinforcement elements being coupled together and folded in the same manner as in FIGS. 17-20. The reinforcements are coupled together by means of a spacer or interconnecting portion 14 of the reinforcement element 1*a*2 which has been inserted into a through hole of the reinforcement element 1*c*1 which is arranged in abutment with the reinforcement element 1*a*2. The spacer or interconnecting portion 14 has been folded to be essentially in the same plane as the reinforcement elements 1*a*2 and 1*c*1, and the reinforcement elements 1*a*2 and 1*c*1 have been displaced relative each other in the lengthwise direction of the reinforcement elements to achieve a strong coupling there between.

FIG. 22 two reinforcements according to the invention being coupled together similarity as in FIG. 21. The outermost tip 16 of the spacer or interconnecting portion 15 has been folded 90 degrees in relation to the rest of the spacer or interconnecting portion. The tip 16 is adapted to engage with a groove or recess 17 of the abutting reinforcement element 1*c*1. Thereby, the reinforcements may be releasably fixed to each other, i.e. relative displacement between the reinforcements in either direction along the lengthwise direction of the reinforcement elements will not separate the reinforcements. In another embodiment, the spacer or interconnecting portion 15 may comprise a tongue, tip or a projection extending from for example the center of the spacer or interconnecting portion and arranged to engage with a corresponding recess or through hole of the reinforcement element 1*c*1. In yet another embodiment, the spacer or interconnecting portion 15 may comprise a recessed portion arranged to engage with a corresponding projecting portion of the reinforcement element 1*c*1.

FIG. 23 shows an embodiment of a reinforcement arrangement comprising a first reinforcement element 1*a*, a second reinforcement element 1*b*, and channel elements 18*a, b* for providing a flow duct function. The channel element 18*a* is arranged on the first reinforcement element along an outer periphery of the long side of the first reinforcement element, and the channel element 18*b* is provided on the reinforcement element at an even distance inwards from the channel element 18*a*. By placing the second reinforcement element 1*b* on top of the channel elements 18*a, b, a* flow channel 19*a* is achieved there between. In other words, a flow channel 19*a* is delimited inbetween the reinforcement elements 1*a, b* by means of the channel elements 18*a, b* arranged there between. A second flow channel 19*b* is defined by corresponding channel elements along the opposite periphery of the first reinforcement element 1*a*. In another embodiment the channel elements may be arranged at a non-even distance from each other. In yet another embodiment, the channel elements are provided along the outer peripheries of the long ends of the reinforcement element(s) and around the inner peripheries of the reinforcement element(s) providing a single flow channel between the reinforcement elements. The channel elements may have a rectangular or square cross section. The channel elements may be seals made from for example rubber or the like, thereby providing a sealing function between the reinforcement elements and the channel elements. In other embodiments, the channel elements may be made from for example a plastic or metal material, and may be sealed to the reinforcement elements with for example a separate seal or sealing glue. The flow channel(s) may advantageously be used for water carried floor heating.

Figure 1:
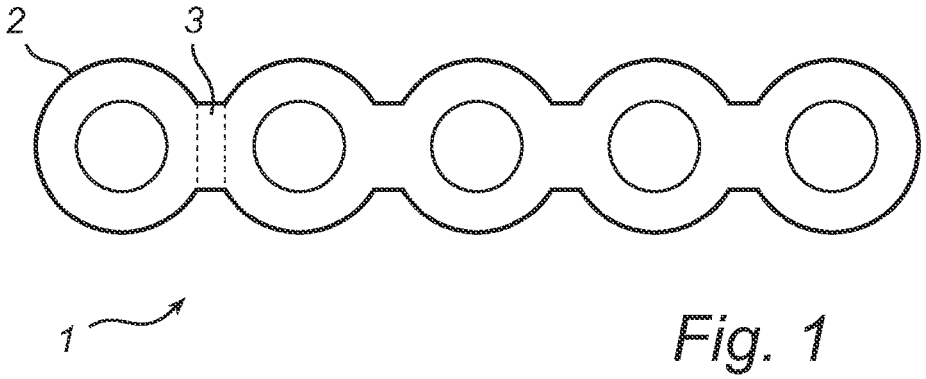
Figure 2:
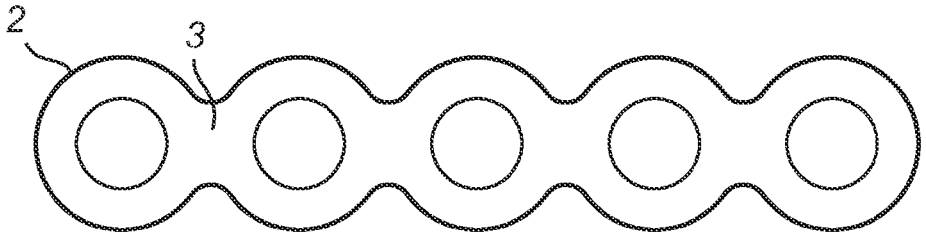
Figure 3:
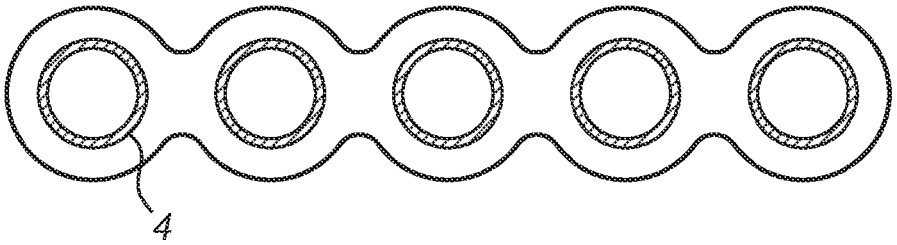
Figure 4:
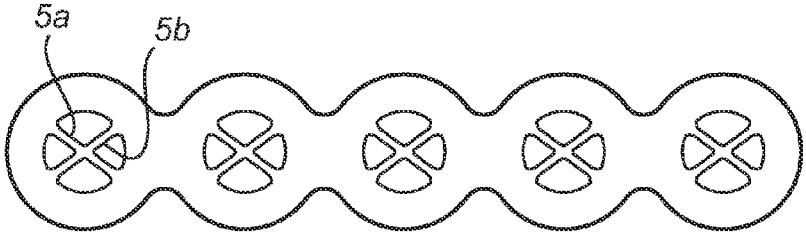
Figure 5:
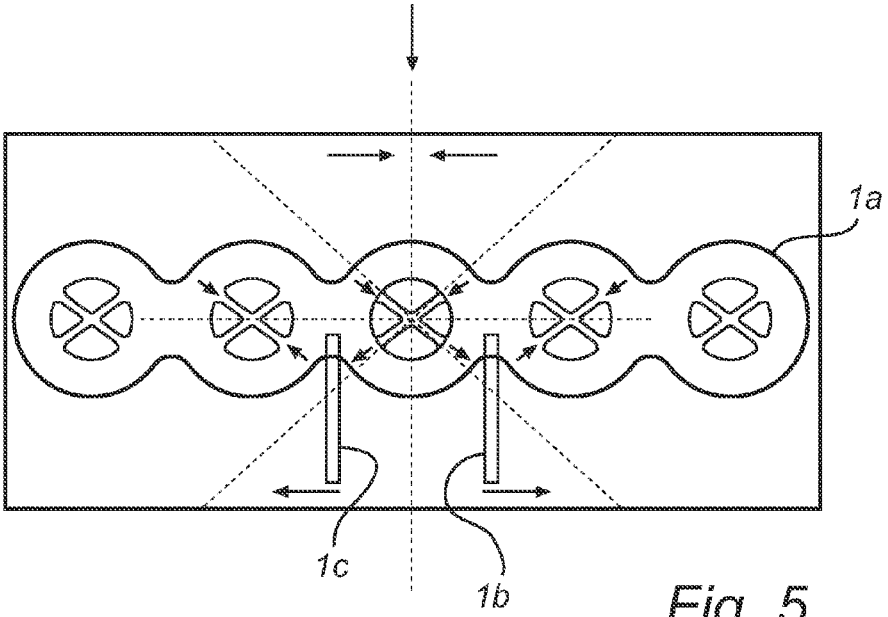
Figure 6:
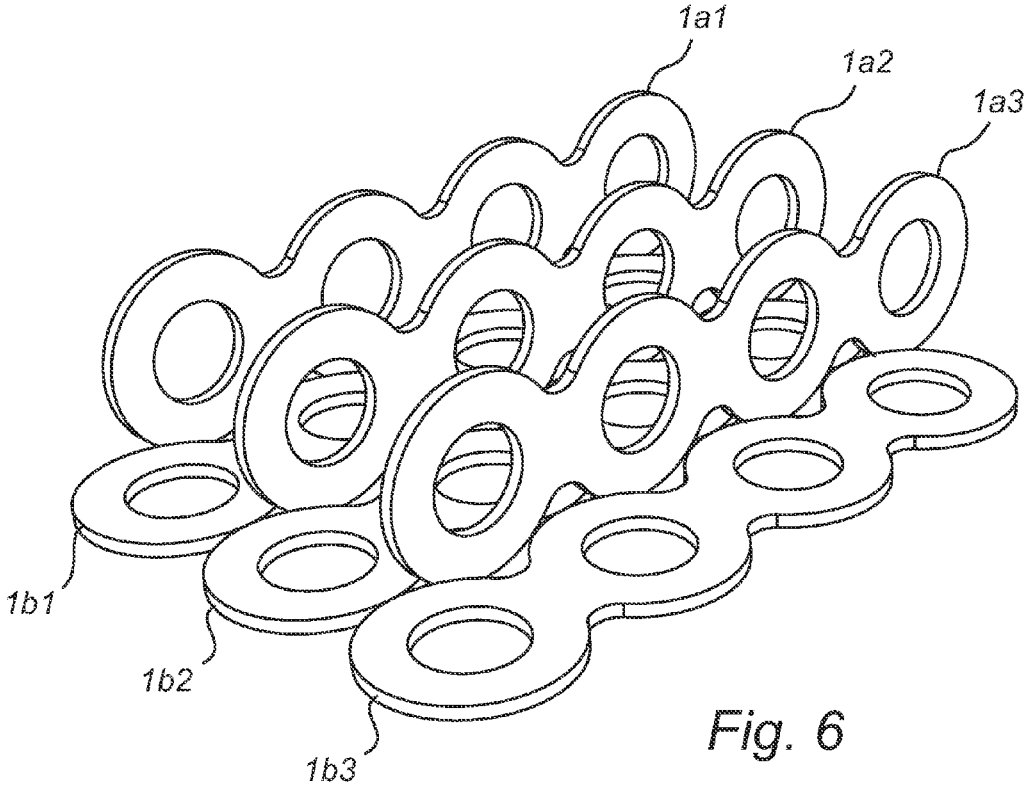
Figure 7:
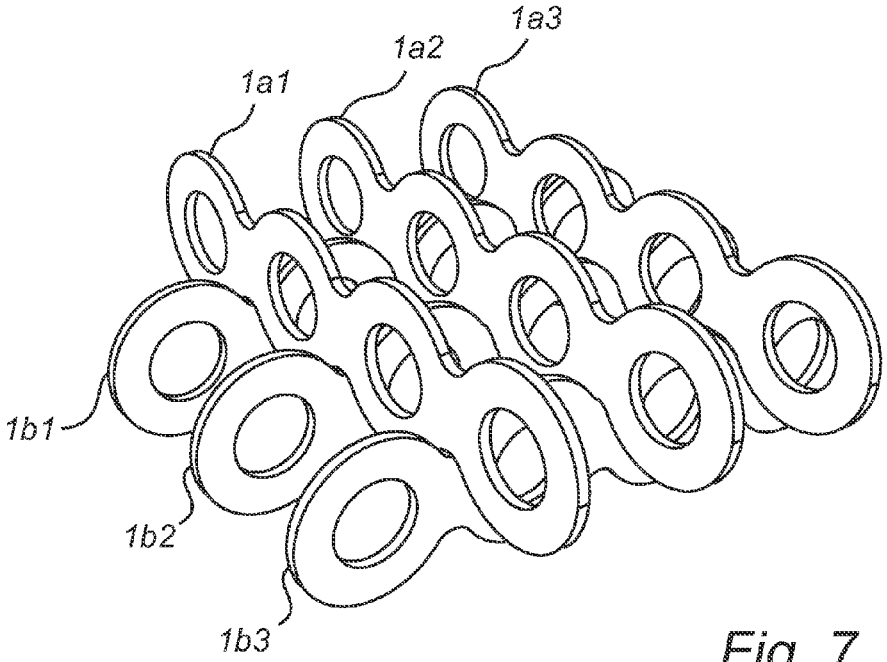
Figure 8:
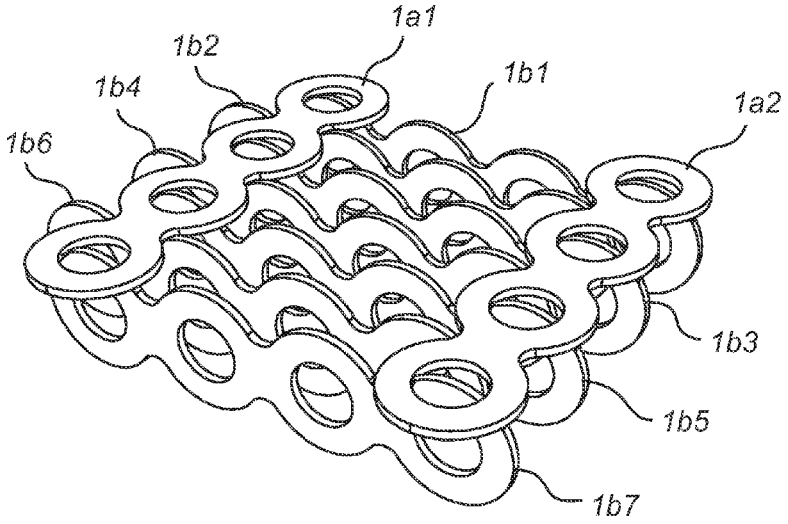
Figure 9:
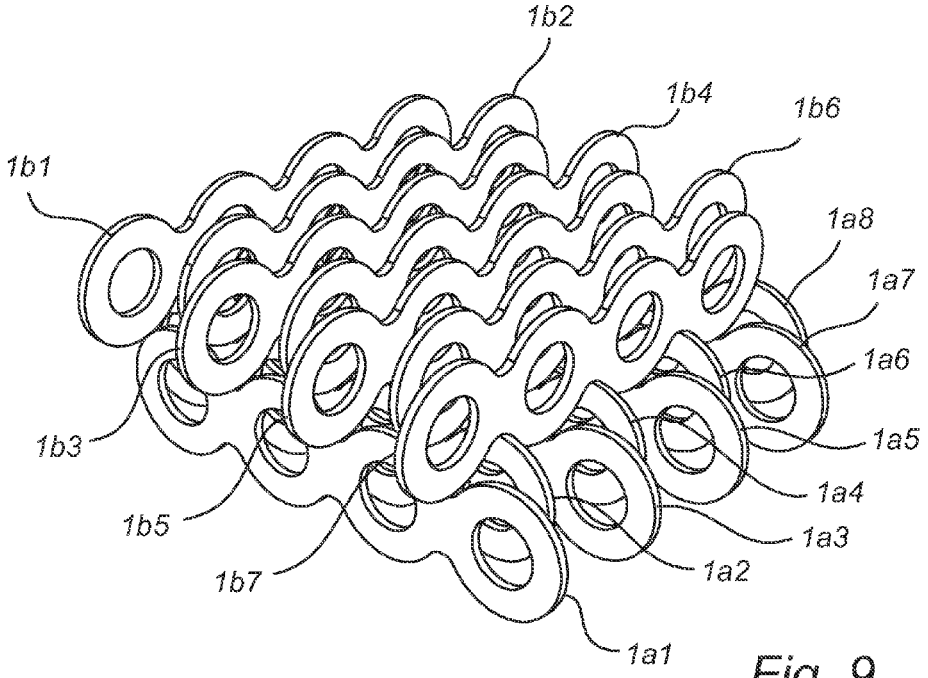
Figure 10:
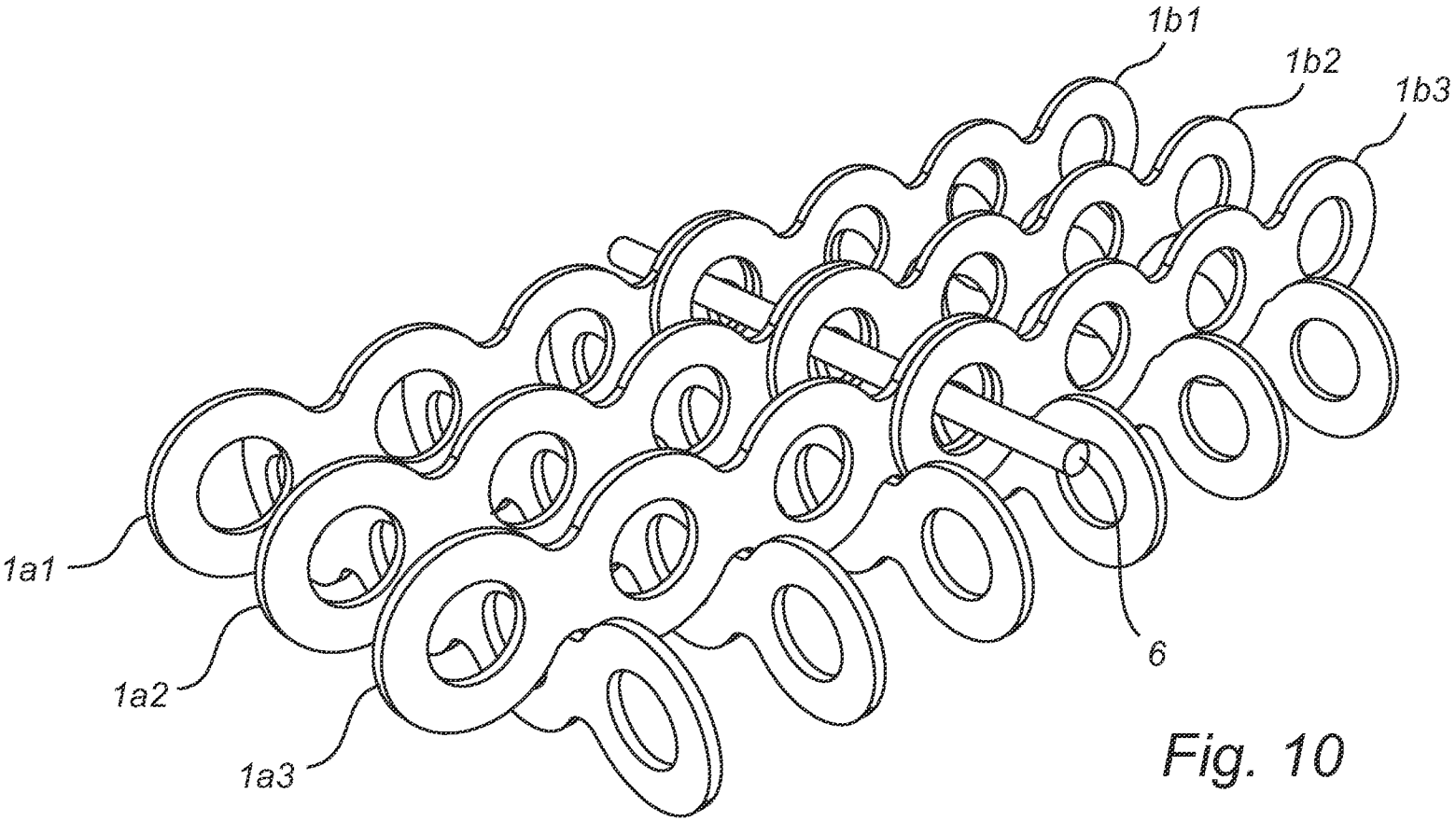
Figure 11:
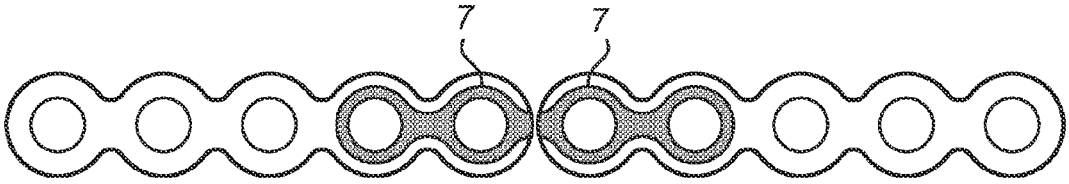
Figure 12:
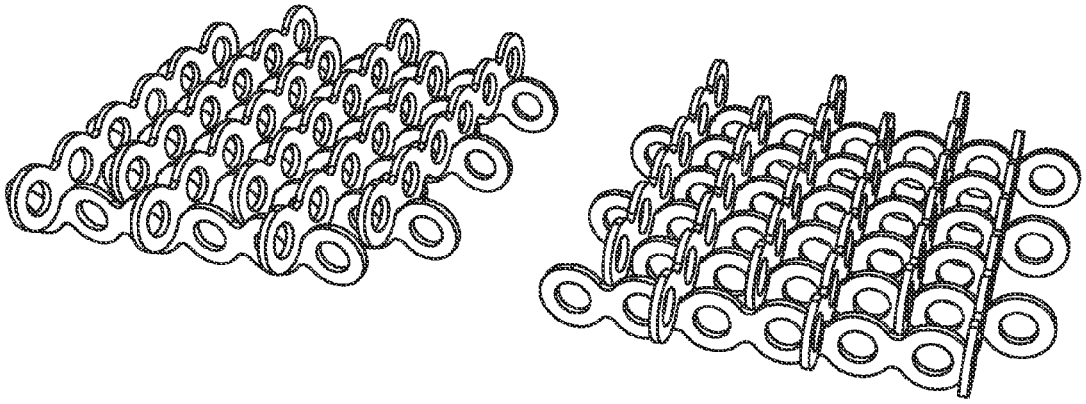
Figure 13:
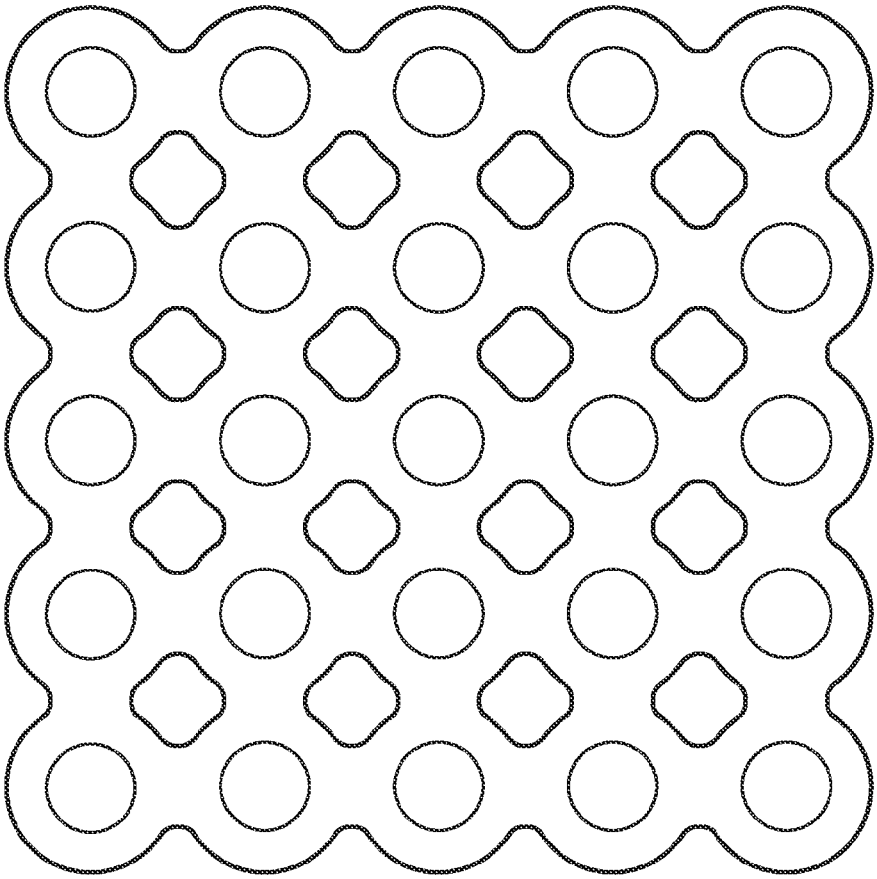
Figure 14:
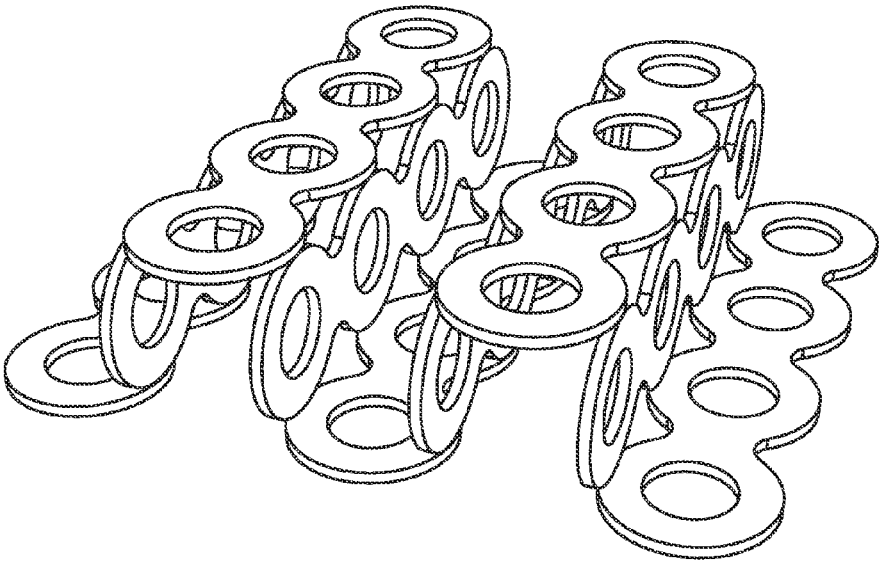
Figure 15:
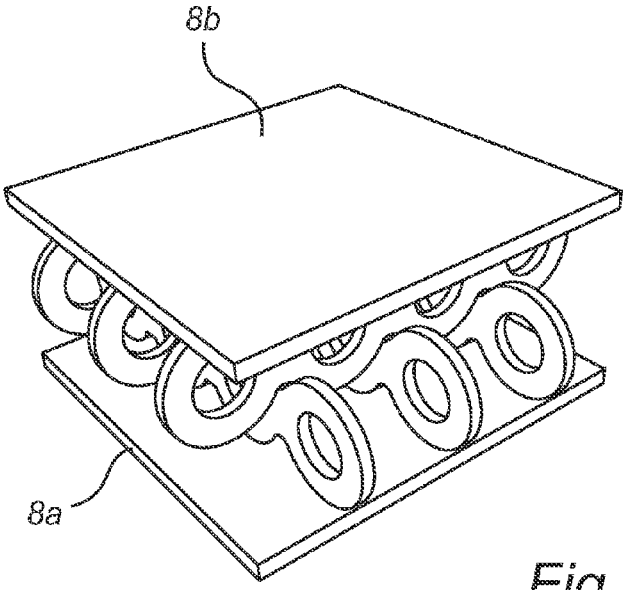
Figure 16:
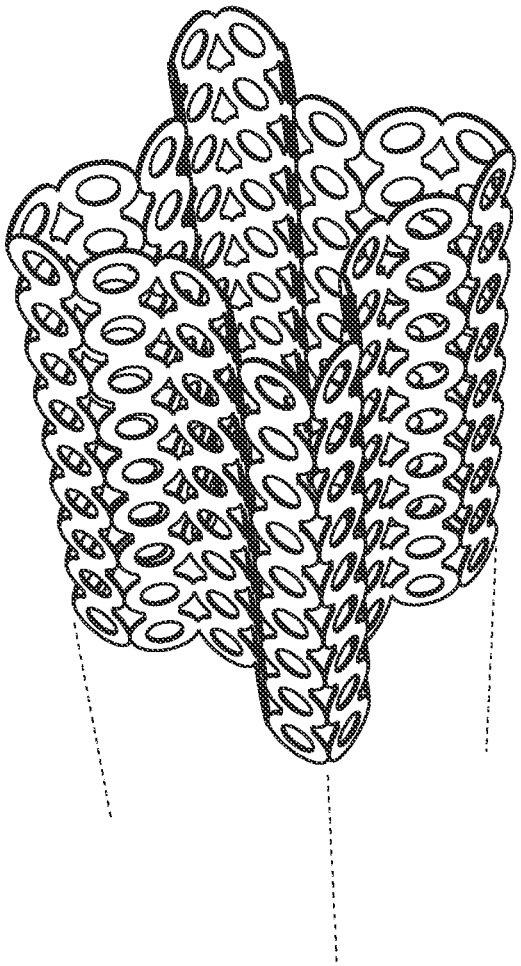
Figure 17:
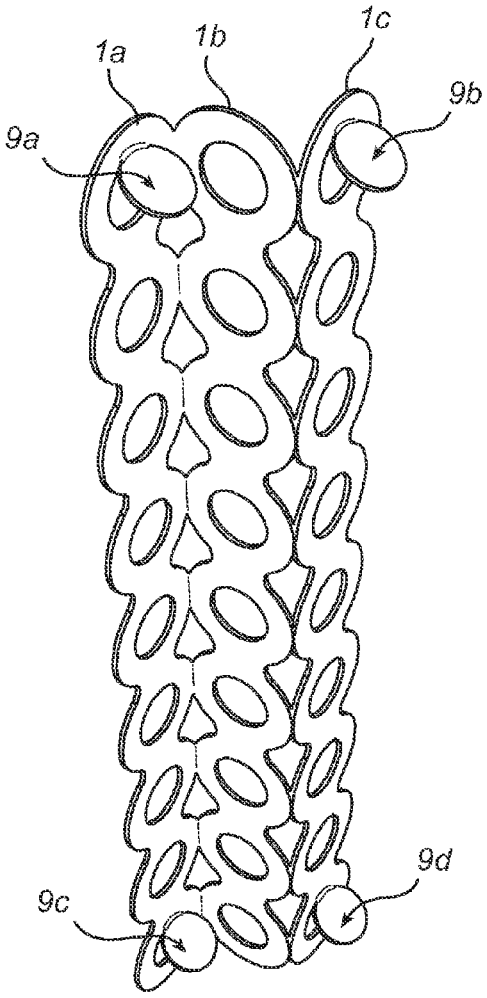
Figure 18:
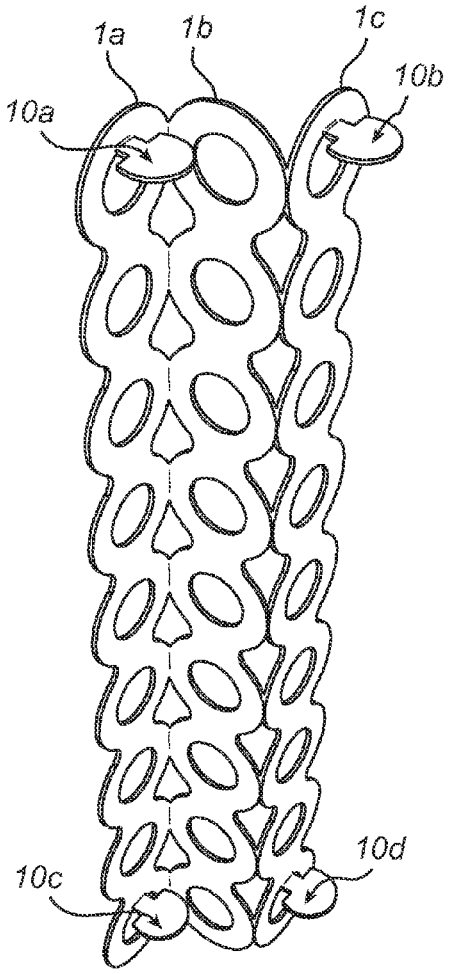
Figure 19:
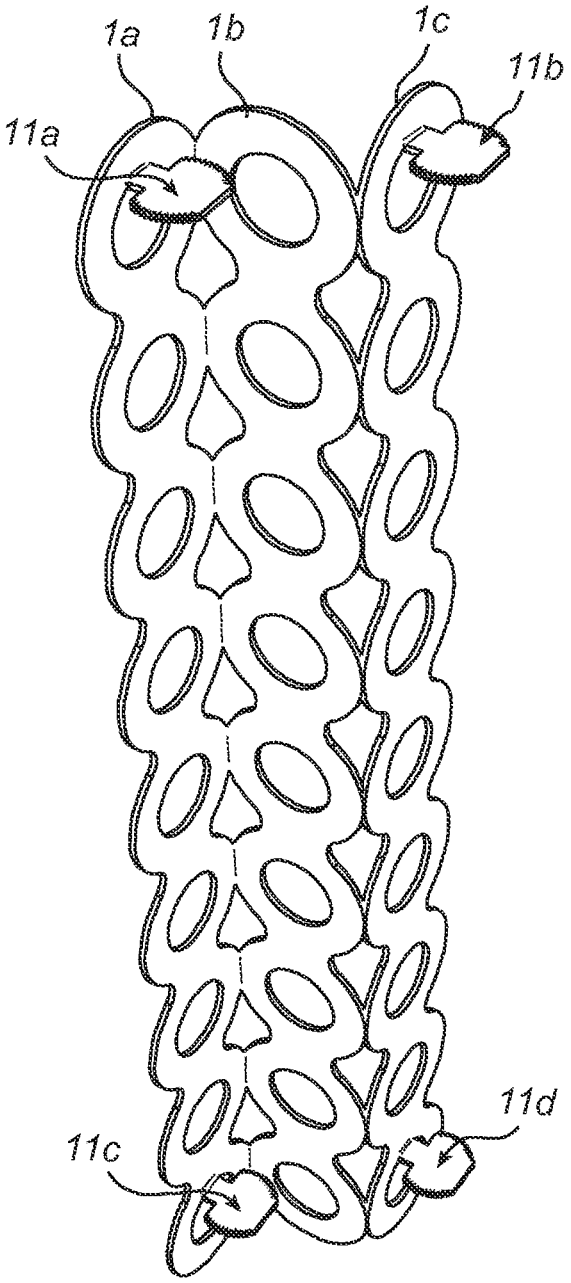
Figure 20A:
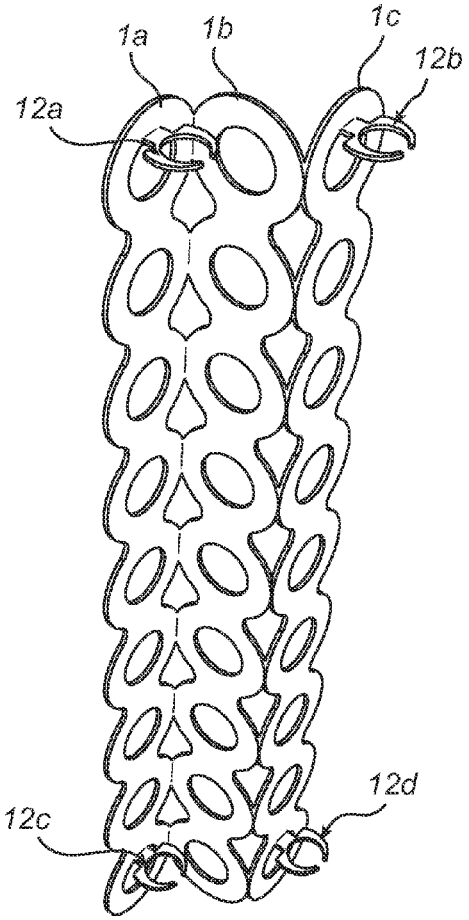
Figure 20B:
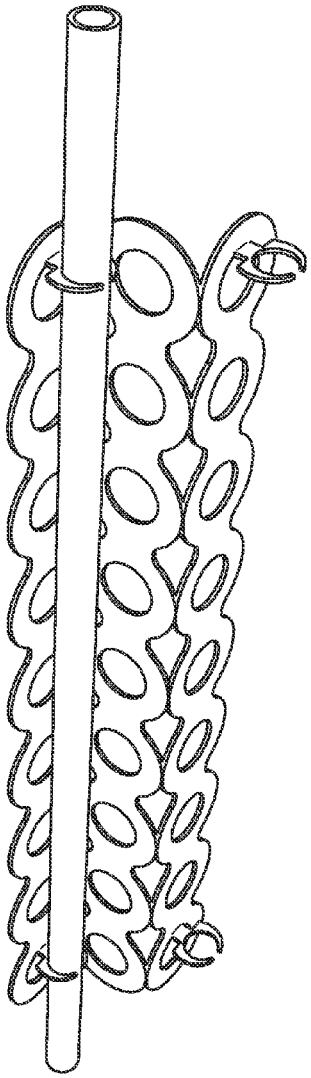
Figure 21:
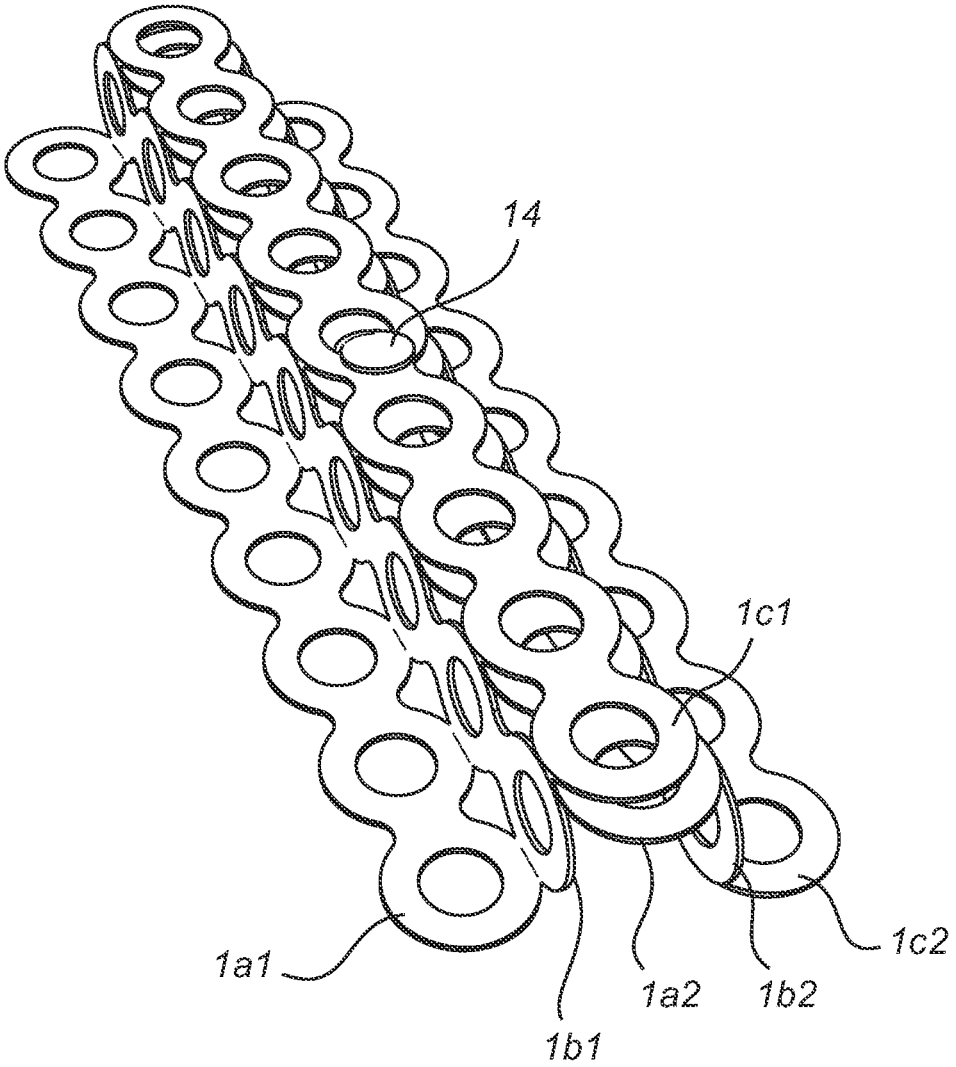
Figure 22:
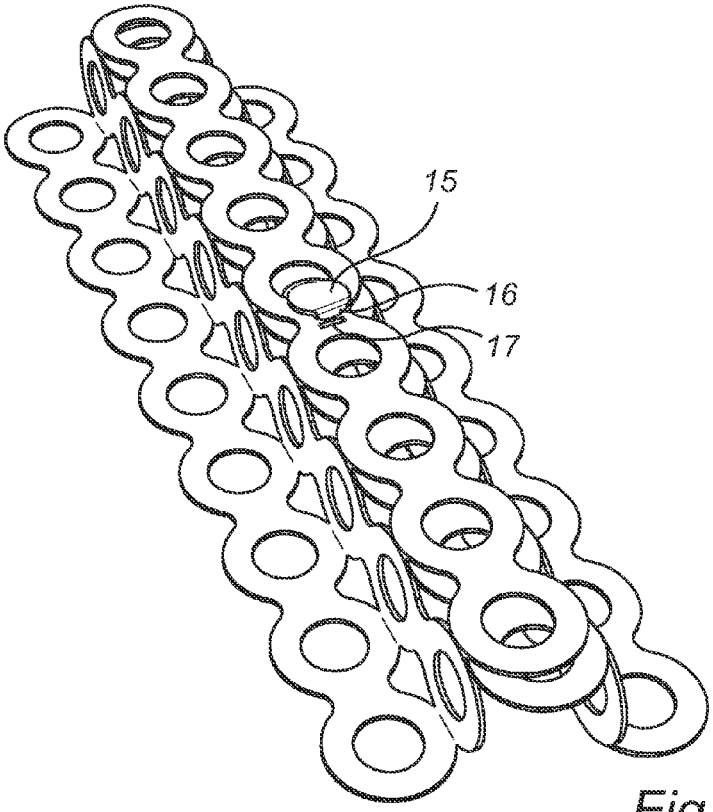
Figure 23:
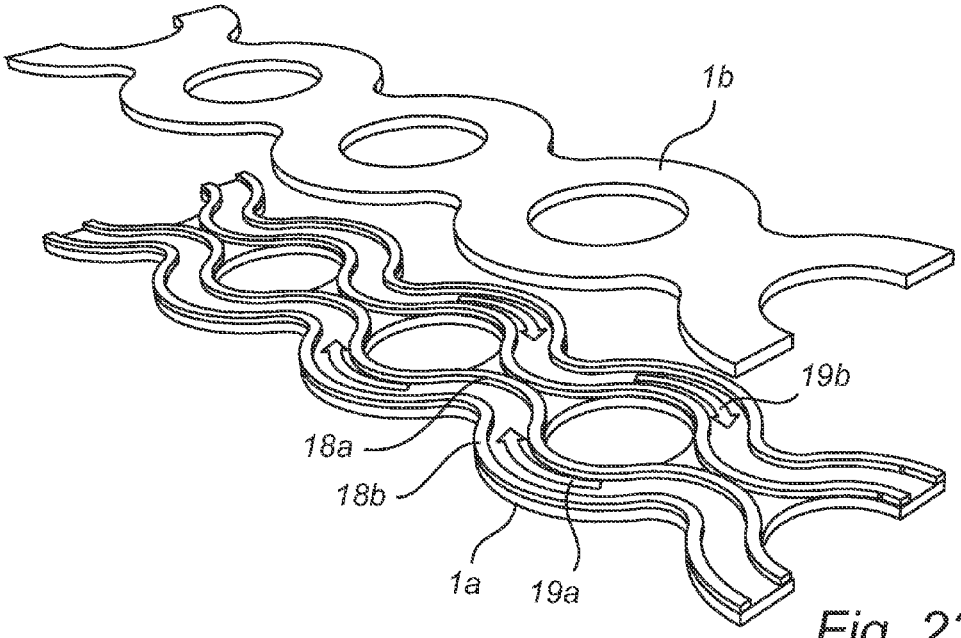
Figure 24:
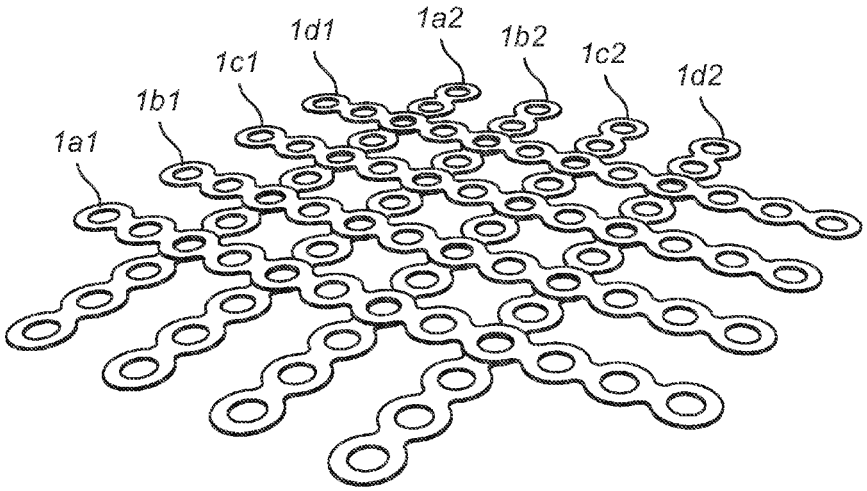
FIG. 24 shows a plurality of reinforcement elements 1*a*1-1*d*1, 1*a*2-1*d*2 according to the second embodiment of the invention being arranged in an intersecting pattern. The reinforcement elements may be welded together in this intersecting pattern.
Figure 25:
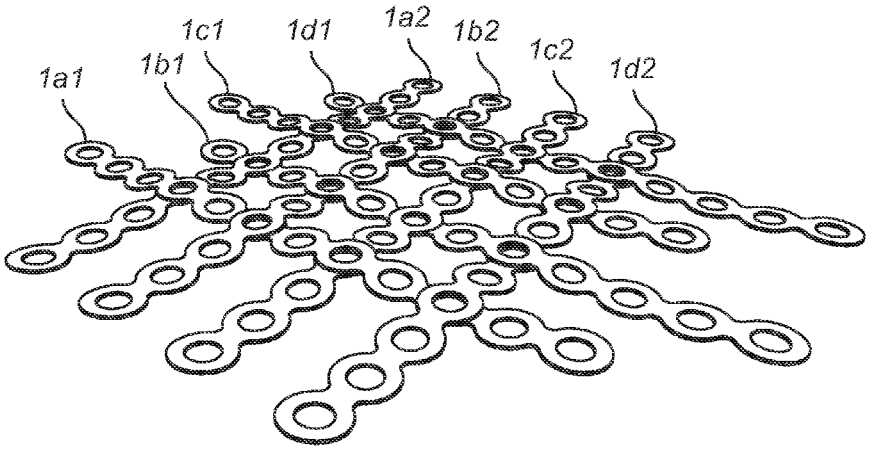
FIG. 25 shows a plurality of reinforcement elements 1*a*1-1*d*1, 1*a*2-1*d*2 according to the second embodiment of the invention being arranged in a woven and intersecting pattern.
Figure 26:
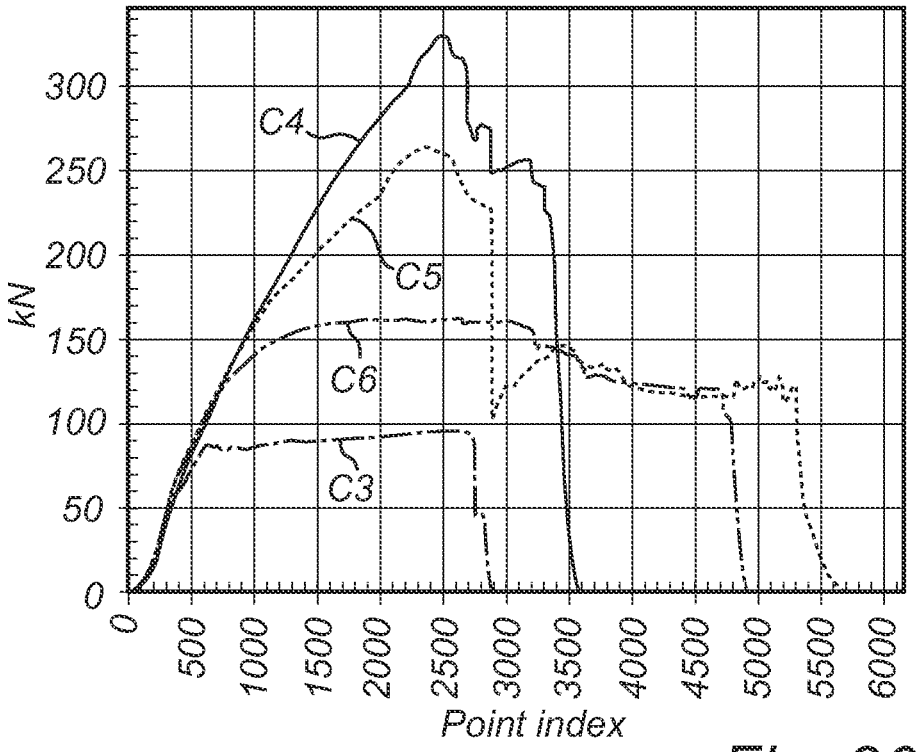

FIG. 26 shows measurement results from a declension test of concrete beam being reinforced with a plurality of reinforcement elements according to the second embodiment of the invention. The dimensions of the beams are 1200 mm long, 200 mm high and 250 mm wide. The reinforcement elements are arranged alternately horizontally and vertically, i.e. alternately lying down and standing the sides of their long ends in the beams. The reference R3 is a beam reinforced with conventional reinforcement rods of 8 mm diameter with steel quality B500B. The reference is compared with beams with reinforcement elements according to the invention, C4, C5, C6, all having a thickness of 2 mm, inner diameter of the rings of 30 mm and outer diameter of the rings of 50 mm. C4 is manufactured from a steel quality having tensile strength of 1500 N/mm$^2$, and C5 and C6 from qualities of steel having tensile strengths of 1000 N/mm$^2$ and 500 N/mm$^2$ respectively. As shown in FIG. 26, the concrete beams having reinforcement beams according to the invention achieves a load capacity which is 71-246% higher than the reference. Furthermore, FIG. 26 shows that high quality steel significantly improves the load capacity. Contrary to the prejudice that high strength steel is unsuitable for reinforcements, it has thus proven advantageous to use such high strength steel in a reinforcement element according to the invention.

Figure 27:
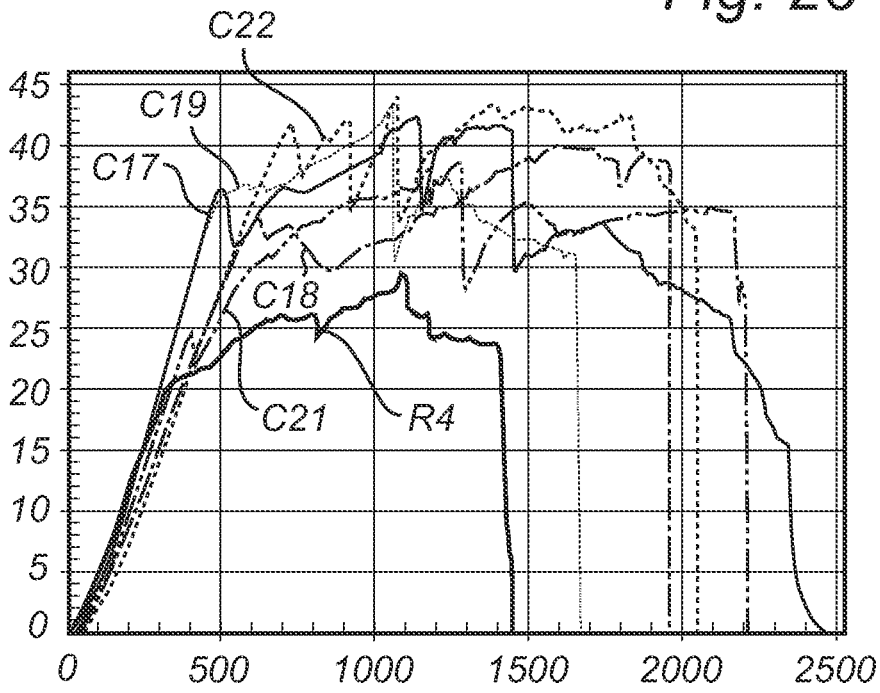

FIG. 27 shows measurement results from a declension test of EPS concrete beams being reinforced with a plurality of reinforcement elements according to the second embodiment of the invention. The dimensions of the beams are 1200 mm long, 200 mm high and 250 mm wide. The reinforcement elements are arranged vertically, i.e. standing on the sides of their long ends in the beams. The reference R4 is a beam reinforced with conventional reinforcement rods of 10 mm diameter with steel quality B500B. The reference is compared with beams with reinforcement elements according to the invention of various steel qualities and dimensions (denoted C17, C18, C19, C21 and C22). The reinforcement elements have thicknesses of 1-2 mm, outer diameters of the rings of 50-75 mm, and inner diameters of the rings of 30-55 mm. As shown in FIG. 27, the beams with reinforcement elements according to the invention achieves a load capacity which is 32-50% higher than the reference, despite having weights being 23-50% lower.

EMBODIMENT LIST

1. A reinforcement element (1, 1*a-c*, 1*a*1-8, 1*b*1-7) for casting comprising ring-shaped portions (2), characterized in that said reinforcement element (1, 1*a-c*, 1*a*1-8, 1*b*1-7) comprises at least one row of consecutive ring-shaped portions (2) being coupled together with necks (3).
2. A reinforcement element (1, 1*a-c*, 1*a*1-8, 1*b*1-7) according to embodiment 1, characterized in that said reinforcement element is formed by a substantially plane element.
3. A reinforcement element (1, 1*a-c*, 1*a*1-8, 1*b*1-7) according to embodiment 1 or 2, characterized in that at least one neck (3) transcends into the ring-shaped portions (2) to which it is coupled with a smoothly curved shape.
4. A reinforcement element (1, 1*a-c*, 1*a*1-8, 1*b*1-7) according to any one of the embodiments 1-3, characterized in that the inner periphery of at least one ring-shaped portion (2) is formed of a material having a greater strength than the rest of the at least one ring-shaped portion (2).
5. A reinforcement element (1, 1*a-c*, 1*a*1-8, 1*b*1-7) according to embodiments 4, characterized in that the reinforcement element is formed of metal and that the inner periphery of at least one ring-shaped portion (2) is differently hardened than the rest of the at least one ring-shaped portion (2).
6. A reinforcement element (1, 1*a-c*, 1*a*1-8, 1*b*1-7) according to embodiment 4, characterized in that at least one ring-shaped portion (2) comprises at least one cross brace (5*a, b*) extending over the opening of the at least one ring-shaped portion (2).
7. A reinforcement element (1, 1*a-c*, 1*a*1-8, 1*b*1-7) according to any one of the previous embodiments, characterized in that the reinforcement element comprises consecutive column wise arranged rows of consecutive ring-shaped portions (2).
8. A reinforcement for casting comprising ring-shaped portions (2), characterized in that said reinforcement comprises reinforcement elements (1, 1*a-c*, 1*a*1-8, 1*b*1-7) comprising at least one row of consecutive ring-shaped portions (2) being coupled together with necks (3).
9. A reinforcement according to embodiment 8, characterized in that said reinforcement comprises at least two sets of reinforcement elements, wherein the reinforcement elements of the first set has a lengthwise axis directed in a first lengthwise direction, and the perpendicular of the plane of the reinforcement element is directed in a first perpendicular direction, and wherein the reinforcement elements of the second embodiment has a lengthwise axis directed in a second lengthwise direction, and the perpendicular of the plane of the reinforcement element is directed in a second perpendicular direction, wherein at least either the angle between the first and second lengthwise directions differ from zero or the angle between the first and second perpendicular directions differ from zero.
10. A reinforcement according to embodiment 9, characterized in that at least either the angle between the first and second lengthwise directions is right or the angle between the first and second perpendicular directions is right.
11. A reinforcement according to any one of the embodiments 8-10, characterized in that at least one of the necks of said first set of reinforcement elements rest on at least one of the necks of the second set of reinforcement elements.
12. A reinforcement according to any one of the embodiments 8-11, characterized in that the first set of reinforcement element is divided into at least two sub sets, wherein at least one reinforcement element of the first sub set overlaps at least one reinforcement element of the second sub set, such that a straight reinforcement member (6) can be thread through the ring-shaped portions (2) of both reinforcement elements.

Although exemplary embodiments of the present invention has been shown and described, it will be apparent to the person skilled in the art that a number of changes and modifications, or alterations of the invention as described herein may be made. Thus, it is to be understood that the above description of the invention and the accompanying drawing is to be regarded as a non-limiting example thereof and that the scope of the invention is defined in the appended patent claims.

The invention claimed is:

1. A reinforcement arrangement for being positioned within a cast to elastically withstand tensile loads thereon, comprising at least two reinforcement elements, each one of the reinforcement elements comprising:

at least one row of consecutively arranged ring-shaped portions, each one of the ring-shaped portions defining a void without structure of the reinforcing element therein, wherein at least two of the ring-shaped portions are formed in one piece, without previously-separate coupled together pieces, from a sheet- or plate-shaped body, with the sheet- or plate-shaped body having a contiguous planar surface that extends over the entity of the body except at the void of each one of the ring-shaped portions and forms a neck coupling said at least two ring-shaped portions to each other, wherein the at least two reinforcement elements are coupled to each other, thereby forming a matrix of consecutively coupled ring-shaped portions.

2. The reinforcement arrangement according to claim 1, wherein the consecutively coupled ring-shaped portions are coupled to each other via neck or coupling portions along a centre line collinear with the centre of the ring-shaped portions in the row.

3. The reinforcement arrangement according to claim 1, wherein the neck or coupling portions are configured with a cross-sectional dimension as viewed in the direction of the row able to withstand greater tensile load than that of the ring-shaped portion.

4. The reinforcement arrangement according to claim 1, wherein the ring-shaped portions between the neck or coupling portions comprise a uniform cross-section in the direction of the ring-shape portion.

5. The reinforcement arrangement according to claim 1, wherein the neck or coupling portions are narrow portions between the ring-shaped portions thereby forming a waist there between.

6. The reinforcement arrangement according to claim 1, wherein at least one of the neck or coupling portions transcends into the ring-shaped portions to which it is coupled with a smoothly curved shape.

7. The reinforcement arrangement according to claim 1, wherein the ring-shaped portions are plane sheet- or plate-shaped.

8. The reinforcement arrangement according to claim 1, wherein the ring-shaped portions at least partly overlap each other or are arranged essentially in abutment or tangentially with each other.

9. The reinforcement arrangement according to claim 1, wherein the ring-shaped portion enclose a hole adapted to be filled with casting material during casting.

10. The reinforcement arrangement according to claim 9, wherein the diameter of the hole and the thickness of the plane sheet- or plate-shaped body are configured to allow the hole to be completely filled with casting material during the casting.

11. The reinforcement arrangement according to claim 1, wherein the periphery of said reinforcement element has substantially smooth surfaces.

12. The reinforcement arrangement according to claim 1, wherein the inner periphery of at least one of the ring-shaped portions is formed of a material having a greater strength than the rest of the at least one ring-shaped portion.

13. The reinforcement arrangement according to claim 1, wherein the reinforcement element is formed of metal and that the inner periphery of the ring-shaped portions are differently hardened than the rest of the ring-shaped portions.

14. The reinforcement arrangement according to claim 1, wherein the reinforcement element further comprises a plane sheet- or plate-shaped folding portion coupled to an inner periphery portion of the ring-shaped portion, wherein the folding portion is foldable relative the reinforcement element body.

15. The reinforcement arrangement according to claim 14, wherein the folding portion is a arranged to be a spacing and/or interconnecting portion relative to an additional reinforcement element.

16. The reinforcement arrangement according to claim 15, wherein said folding portion comprises at least one projecting or recessed portion adapted to engage with an additional reinforcement element.

17. The reinforcement arrangement according to claim 1, wherein the rows of reinforcement elements are foldable relative each other such that a three-dimensional reinforcement arrangement may be achieved.

18. The reinforcement arrangement according to claim 1, further comprising at least one channel element arranged between two reinforcement elements such that at least one channel is formed between the two reinforcement elements to allow a fluid flow there between.

19. The reinforcement arrangement according to claim 18, wherein said channel element comprises first channel portions extending along the long sides of the outer periphery the reinforcement elements and second channel portions extending along the inner peripheries of the ring shaped portions or extending essentially in parallel with the first channel portions.

20. The reinforcement arrangement according to claim 1, wherein a first one of said reinforcement elements is formed from a first material and a second one of said reinforcement elements is formed from a second material, such that an electrical current is generated when said reinforcement elements are arranged at a distance from each other in a casting material.

* * * * *